US008137244B2

(12) United States Patent
Blaylock

(10) Patent No.: US 8,137,244 B2
(45) Date of Patent: Mar. 20, 2012

(54) CROSS OVER FLYWHEEL EXERCISE DEVICE

(76) Inventor: Andrew Blaylock, Bloomington, MN (US)

( * ) Notice: Subject to any disclaimer, the term of this patent is extended or adjusted under 35 U.S.C. 154(b) by 4 days.

(21) Appl. No.: 12/814,724

(22) Filed: Jun. 14, 2010

(65) Prior Publication Data

US 2010/0317491 A1 Dec. 16, 2010

Related U.S. Application Data

(63) Continuation of application No. 10/854,440, filed on May 26, 2004, now Pat. No. 7,744,506.

(60) Provisional application No. 60/473,765, filed on May 28, 2003.

(51) Int. Cl.
*A63B 22/00* (2006.01)

(52) U.S. Cl. ..... 482/51; 434/253

(58) Field of Classification Search ..... 482/51, 482/54, 66, 68, 71, 146, 148; 434/253; 472/90, 472/91

See application file for complete search history.

(56) References Cited

U.S. PATENT DOCUMENTS 3,195,889 A * 7/1965 Hall ..... 472/91
4,340,214 A 7/1982 Schutzer
4,779,862 A 10/1988 Keppler
4,940,226 A 7/1990 Carra
5,052,682 A 10/1991 Croce, Jr. et al.
5,076,571 A 12/1991 Croce, Jr. et al.
5,114,387 A 5/1992 Keppler
5,184,980 A * 2/1993 Ferris ..... 472/91
5,284,460 A 2/1994 Miller et al.
5,322,490 A 6/1994 Van Der Hoeven
5,328,427 A 7/1994 Sleamaker
5,352,165 A 10/1994 Koblick
5,385,520 A 1/1995 Lepine et al.
5,393,282 A 2/1995 Maclean
5,413,545 A * 5/1995 Bermann ..... 482/71
5,649,865 A * 7/1997 Harvey ..... 472/90
6,090,015 A * 7/2000 Meyers ..... 482/54
6,227,759 B1 5/2001 Fricke et al.
6,280,366 B1 8/2001 Hsieh
6,939,236 B2 * 9/2005 McLaren et al. ..... 472/90

* cited by examiner

*Primary Examiner* — Loan Thanh
*Assistant Examiner* — Tam Nguyen
(74) *Attorney, Agent, or Firm* — Marsh Fischmann & Breyfogle LLP

(57) ABSTRACT

An exercise device for the crossover step, including an upper wheel supported, the upper wheel having a skating surface and being rotatable; a lower wheel joined to the upper wheel via a hub, the lower wheel having idler wheels supporting the upper wheel; upper legs and lower legs, the upper and lower legs being joined to the lower wheel; a track joined to the upper legs and lower legs, the track adapted to allow the upper wheel, lower wheel, upper legs and lower legs to be stored vertically against a wall and positioned for use adjacent a floor; and mechanism for controlled increase of simulated G-forces applied to a skater skating on the skating surface.

17 Claims, 4 Drawing Sheets

CROSS OVER FLYWHEEL EXERCISE DEVICE

CROSS-REFERENCE TO RELATED APPLICATIONS

This patent application is a continuation of U.S. patent application Ser. No. 10/854,440, entitled "CROSS OVER FLYWHEEL EXERCISE DEVICE", and filed May 26, 2004 (U.S. Pat. No. 7,744,506, issued Jun. 29, 2010), which claims priority to U.S. Provisional Patent Application Ser. No. 60/473,765, filed May 28, 2003, and entitled "CROSS OVER FLYWHEEL EXERCISE DEVICE" (expired). Priority is claimed to each of these patent applications, and the entire disclosure of each such patent application is incorporated by reference in its entirety herein.

FIELD OF THE INVENTION

The present invention relates to exercise devices and more particularly exercise devices teaching the cross-over step of ice skating.

BACKGROUND OF THE INVENTION

The crossover step in ice skating is perhaps the most difficult maneuver to learn and may well be the most exhausting step to learn as well. The crossover step is used in turning and essentially involves the skater taking the outside foot, stepping over the inside foot, taking the original inside foot and repositioning it on the inside. Through repeating the step, the skater turns, while in motion. Generally, the cross-over step involves leaning into the turn. Many exercise devices have been developed, including those for ice skating. A review of the prior art in the field shows a great need for improved technology for practicing the most difficult technique in ice skating.

U.S. Pat. No. 6,090,015 (Meyers) discloses a training aid for learning the cross-over step. Generally, the device is positioned on a skating surface at a fixed point. The skater grasps a bar that is pivotally mounted to a center post and skates in a circle. This invention does not simulate the leaning, gravitational forces and needs to be mounted to a skating surface.

U.S. Pat. No. 5,393,282 (Maclean) discloses an exercise device that sort of mimics the steps a skater may use to skate in a straight line. This reference teaches a surface on which a sliding motion may be encountered similar to skating. This reference does not teach the cross-over step or simulation of the forces encountered in executing the cross-over step.

What is needed is a device that teaches the cross-over step. Desirably, the device should simulate the forces encountered during actual execution of the cross-over step on a skating rink, the speed should be adjustable and the device should be easy to store and to set up for use.

SUMMARY OF THE INVENTION

The present invention is an exercise device for the cross-over step. The device may include an upper wheel, a lower wheel, upper legs, lower legs and a track. The upper wheel preferably has a skating surface and is rotatable. The upper wheel has a storage position and a use position. The lower wheel can be joined to the upper wheel via a hub with the lower wheel having idler wheels supporting the upper wheel. Upper legs and lower legs desirably are joined to the lower wheel. The track joins to the upper legs and lower legs. The track is adapted to facilitate movement of the upper wheel between the storage position and use position.

Advantageously, the present invention allows a skater to practice the cross-over step without the need for a large ice skating rink.

Also as an advantage the present invention provide mechanism for simulating G-forces on the skater.

As still yet another advantage, the present invention adjusts for faster and slower skating and wider and tighter turns.

These and other advantages will become clear from reading the below description of the best mode and preferred embodiment with reference to the associated drawings.

DETAILED DESCRIPTION OF THE PRESENT INVENTION

Figure 1:
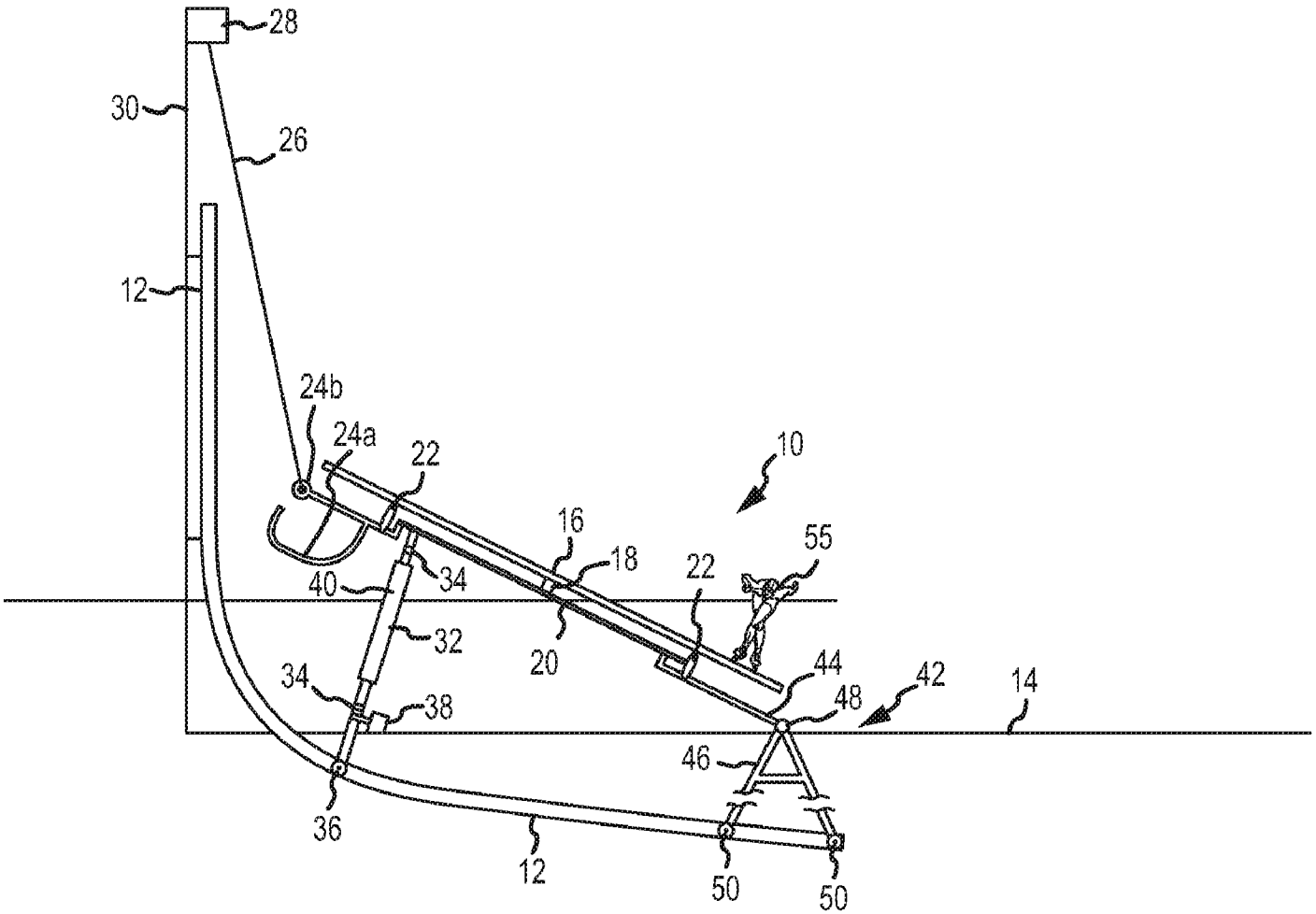
FIG. 1 is the exercise device of the present invention oriented for use.

Referring to FIG. 1 the crossover flywheel 10 may be used in an inclined position, as shown, to create the feel of G-forces encountered when turning and may be movable along a track 12 extending below the floor 14. Mechanism may be provided to increase or decrease the angle of incline. The flywheel 10 may have an upper wheel 16 joined by a hub 18 to a lower wheel 20. The lower wheel 20 may support idler wheels 22, commonly found in snowmobile tacks, which support and potentially rotate the upper wheel 16. Alternatively, the hub 18 or a pair of opposing wheels on either side of the upper wheel 16 may drive the upper wheel 16. The upper wheel 16 is surfaced either with a suitable polymer or ice to provide the skating surface. The upper wheel 16, perhaps 13 feet or more in radius, is rotated at a controllable and adjustable speed, while the skater practices the crossover step thereon.

Figure 2:
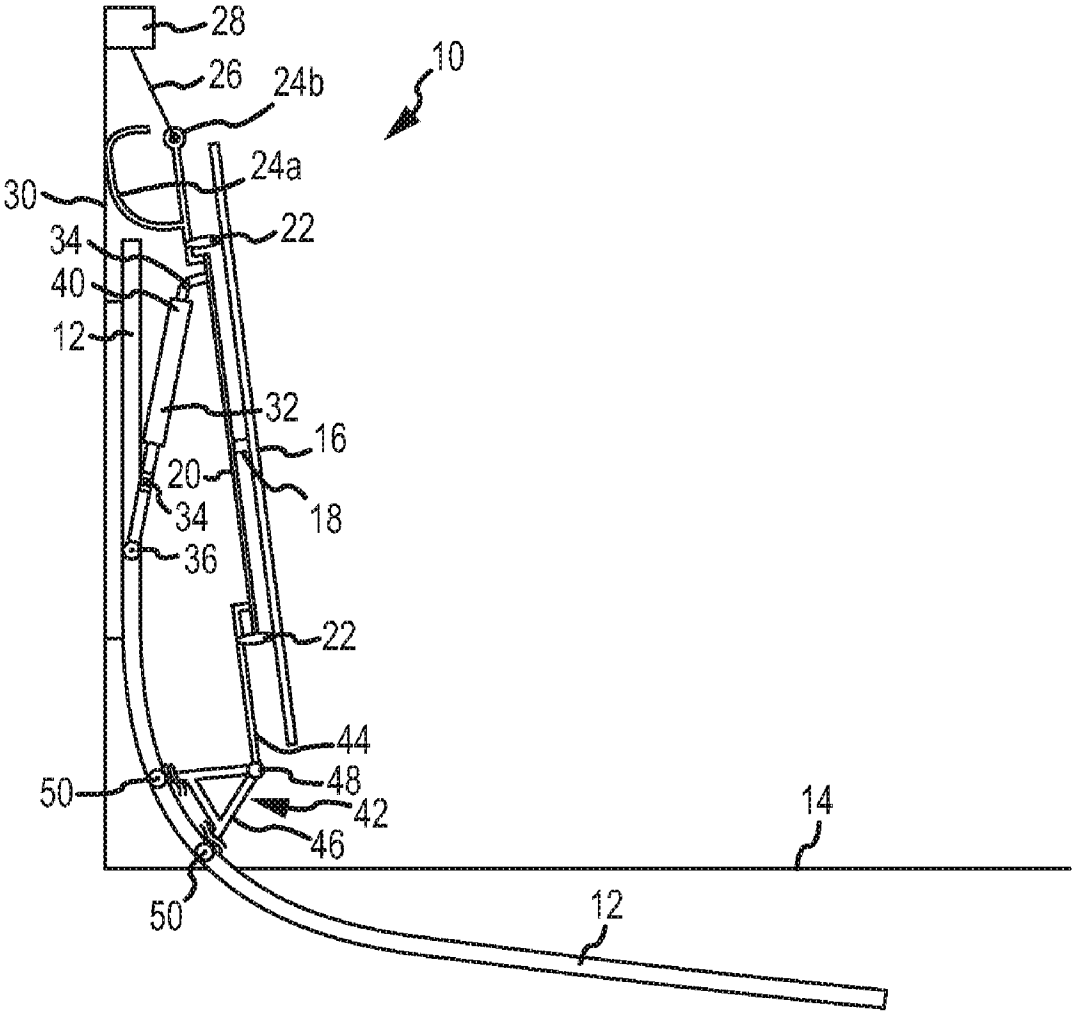
FIG. 2 is the exercise device of the present invention in a storage position.

The upper end of the lower wheel 20 may be joined to at least one, preferably two wall brace and eyepiece units 24*a*, 24*b*. The eye piece portion 24*b* is preferably joined by a cable 26 to a winch 28, allowing it to be drawn up into a storage position as shown in FIG. 2. The wall brace portion 24*a* can be bow-shaped as shown to glide along the wall 30, holding the flywheel 10 at a safe distance.

The upper end of the lower wheel 20 may further be joined to at least one, preferably two upper legs 32. The upper legs 32 include a pair of hinges 34 and a track wheel 36. The hinges 34 allow the legs 32 to collapse when the flywheel 10 is drawn up against the wall 30 as shown in FIG. 2. A clamp 38, joined to the floor 14 and upper legs 32 precludes the hinges 34 from collapsing the upper legs 32 when in a use position, as shown in FIG. 1, presuming the lower legs 42 are held in position. Alternate forms of stiffening the upper legs 32 may be used instead of the clamps 38. The track wheel 36 is preferably positioned within and guided by the track 12 between the use and storage positions as shown in FIGS. 1 and 2 respectively. The upper legs 32 may also incorporate a hydraulic member 40 for cushioning the system as a skater uses the flywheel 10.

The hydraulic member 40, or similar mechanism, may be used to adjust the tilt of the upper wheel 16. In order to accurately simulate the body position while skating at different speeds and radii the tilt of the upper wheel 16 needs to be changed. For instance at faster speeds or shorter radii, a skater needs to lean very low to the skating surface, meaning the tilt needs to be closer to vertical. This machine accurately captures the G-forces and body positions encountered when practicing the cross-over step. A screw device, the cable 26 or other mechanism may be used to change the tilt.

The lower end of the lower wheel 20 may be joined to at least one, preferably two lower legs 42. Note that a table needs at least three legs to be properly supported, creating a preferred situation of having at least two tracks 12. With two tracks, four legs, two pairs of an upper leg 32 and a lower leg 42 may be used with the flywheel 10. The lower legs 42 may include a horizontal brace 44 joined to an A-frame segment 46 via hinge 48. Track wheels 50 join the A-Frame segment 46 to the track 12. The hinge 48 allows the A-frame segment 46 to navigate the change in direction of the track 12 from horizontal to vertical.

The components in FIG. 2 are the same components as that shown in FIG. 1, although repositioned for storage. The upper legs 32 are collapsed via movement of the hinges 34. The cable 26 joined between the eyepiece 24*b* and the winch 28 has been used to draw the two components closer together. Wall braces 24*a* are shown positioned against the wall 30, holding the flywheel 10 a safe distance from the wall 30. The lower legs 42 are slightly repositioned to allow the lower legs 32 to conform to the transition area of the track 12 from horizontal to vertical.

Figure 3:
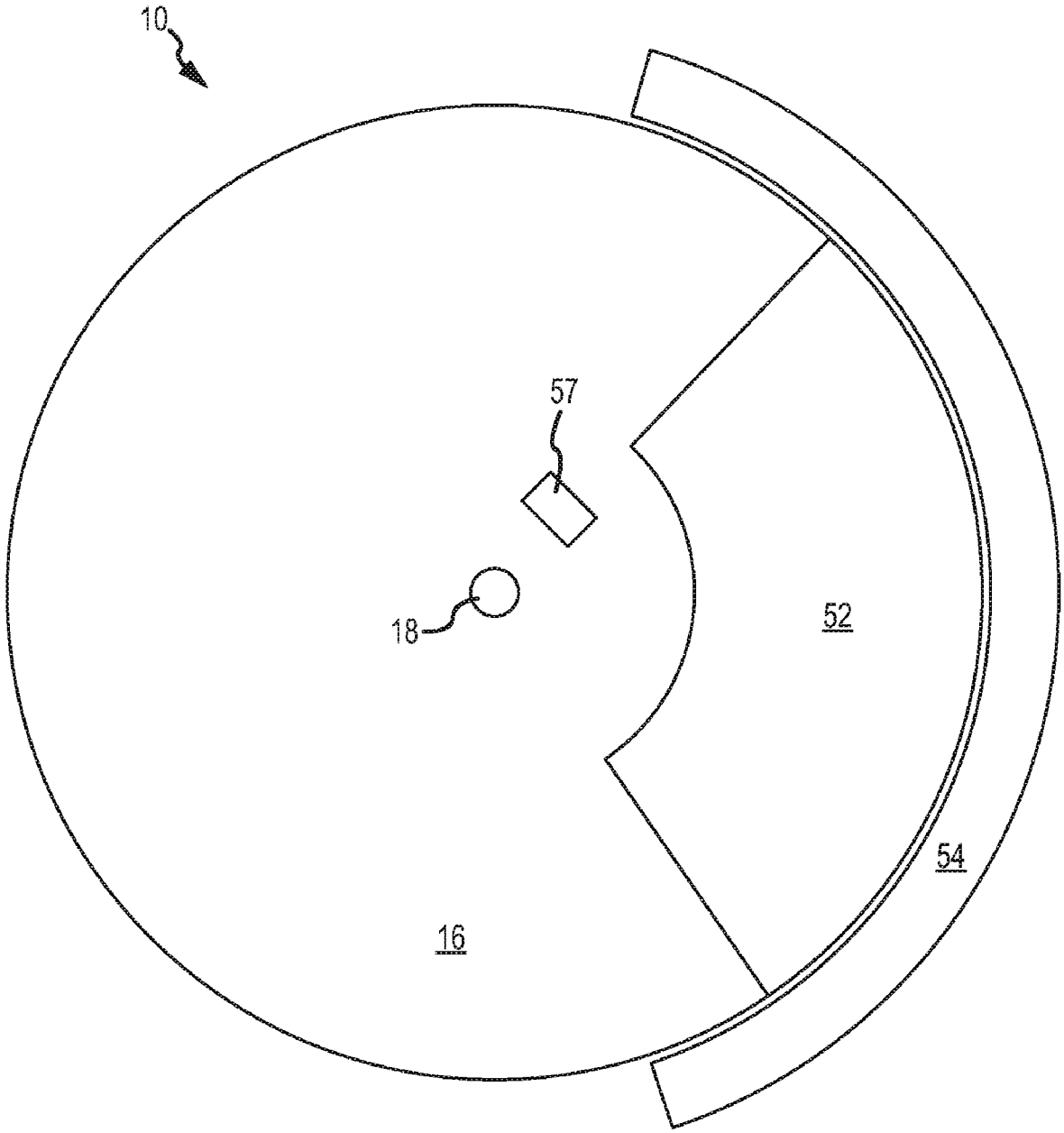
FIG. 3 is a top view of the present invention with a magnetic field to simulate the G-forces.

The flywheel 10 as shown in FIG. 3 includes a skating area 52 adjacent a magnetic field 54. An electromagnet 54 may operate on a metal article of clothing worn by the skater to create the sensation of G-forces encountered when turning. Desirably the magnetic field is generated by the electromagnet 54 due to the strength and adjustability of the strength of the magnet 54 to more accurately simulate actual turning on open ice. That is, the speed the skater is skating, the weight of the skater and the skating radius may be captured in a computer and an algorithm computes the corresponding strength of the magnet 54 (and potentially the tilt of the upper wheel 16). The computer can alter the speed of the upper wheel 16 depending upon the radius at which the skater is skating. The metal clothing desirably allows the magnet to uniformly impact the skater as accurately as possible to actual skating conditions. The use of the magnetic 54 may be an alternative or in addition to the tilting of the flywheel 10. A control panel 57 may provide speed control and direction of rotation control with this or any other embodiment.

Figure 5:
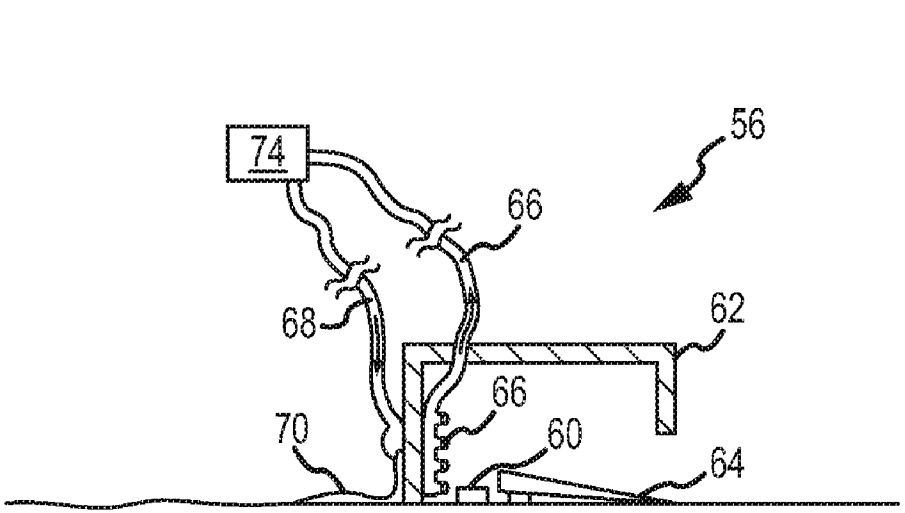
FIG. 5 is a side view of the resurfacing component of the present invention.
Figure 4:
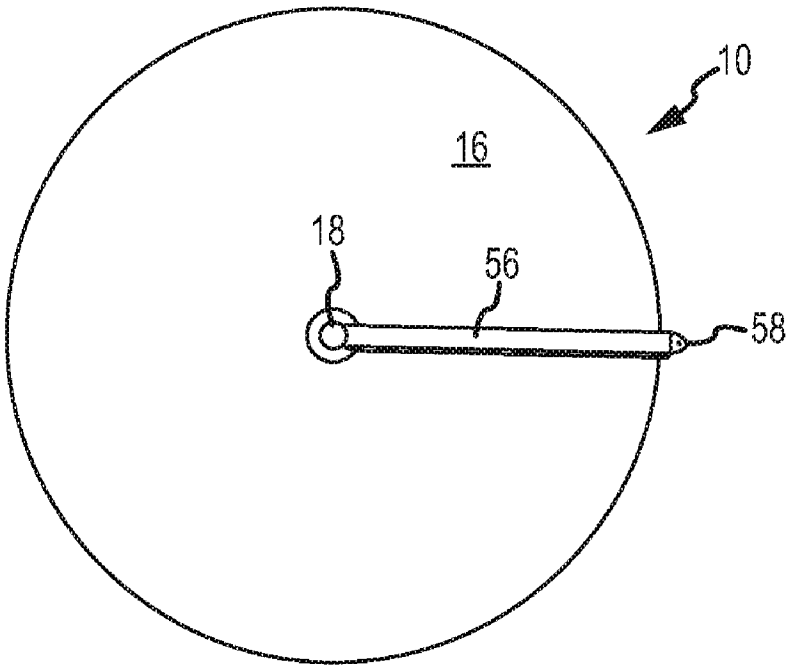
FIG. 4 is a top view of a refrigerated version of the present invention.

FIGS. 4-5 demonstrate an alternative skating surface to plastic, namely ice. FIG. 4 shows the upper wheel 16 positioned against a resurfacing machine 56 with the resurfacing machine joined to the hub 18 and a fixed point 58.

The resurfacing machine 56 is shown in cross section in FIG. 5. A heating element 60 is joined to a shaving shield 62, which catches the ice shavings cut by the blade 64 from the ice. A vacuum 66 draws the captured shavings into a water reservoir 74 where it is heated for later use. The hot water from the reservoir 74 is drawn in through a supply hose 68 and dispensed through a dispensing cloth 70.

The resurfacing machine 56, which is used between skating sessions, may be selectively joined to or removed from the flywheel 10. The resurfacing machine 56 is stationary and oriented such that when the flywheel 10 is rotated, the blade 64 cuts ice shavings from the skating surface. The shavings are captured in the shield 62 and vacuumed 66 out into a reservoir. Ice shavings that are too robust for vacuuming are melted with a heating element 60, converting it to water for easier vacuuming. New ice is added with hot water from the supply hose 68 and to the skating surface by the dispensing cloth 70. While hot water cools slower than cool water it has the added benefit of causing some melting of the unshaved ice and thereby allow the water to re-freeze more uniformly.

Although the present invention has been described with reference to preferred embodiments, workers skilled in the art will recognize changes may be made in form and detail without departing from the spirit and scope of the invention.

I claim:

1. A method for teaching skating, comprising the steps of:
operating an ice skating training device comprising rotating an inclined wheel comprising a skating surface; and
skating on said skating surface of said inclined wheel during said rotating step, wherein said skating step comprises a skater executing crossover steps on said skating surface of said inclined wheel.

2. The method of claim 1, wherein said rotating step comprises rotating said inclined wheel in a first rotational direction.

3. The method of claim 2, wherein said rotating step comprises rotating said inclined wheel in a second rotational direction that is opposite of said first rotational direction.

4. The method of claim 1, wherein said operating step comprises changing an angle of incline of said inclined wheel.

5. The method of claim 4, wherein said changing an angle of incline step accommodates a change in speed of said skating step.

6. The method of claim 4, wherein said changing an angle of incline step accommodates said skating step being executed at a different radius on said inclined wheel.

7. The method of claim 1, wherein said operating step comprises adjusting a speed for said rotating step.

8. The method of claim 7, wherein said adjusting a speed step accommodates a change in speed of said skating step.

9. The method of claim 7, wherein said adjusting a speed step accommodates said skating step being executed at a different radius on said inclined wheel.

10. The method of claim 1, wherein said operating step comprises both changing an angle of incline of said inclined wheel and adjusting a speed for said rotating step.

11. The method of claim 10, wherein said changing an angle of incline step and said adjusting a speed step accommodates said skating step being executed at a different radius on said inclined wheel.

12. The method of claim 1, wherein said operating step comprises increasing an angle of incline of said inclined wheel to allow said skating step to be executed at an increased speed and while said skater leans closer to said inclined wheel.

13. The method of claim 1, wherein said operating step comprises increasing an angle of incline of said inclined wheel to allow said skating step to be executed at a shorter radius on said upper wheel and while said skater leans closer to said inclined wheel.

14. The method of claim 1, wherein said operating step comprises simulating forces encountered by said skater during said executing crossovers step.

15. The method of claim 14, wherein said simulating step comprises adjusting at least one of an angle of incline of said inclined wheel or a speed for said rotating step.

16. The method of claim 15, wherein said simulated forces replicate actual forces experienced by a skater performing a crossover step at a certain speed and a certain radius of a turn.

17. The method of claim 16, wherein said simulated forces replicate actual forces experienced by a skater performing a crossover step in a horizontal plane.

* * * * *